US009488932B1

(12) United States Patent
Josiah et al.

(10) Patent No.: US 9,488,932 B1
(45) Date of Patent: Nov. 8, 2016

(54) METHOD AND SYSTEM FOR CONVERTING A TONER CARTRIDGE PRINTER TO A WHITE, CLEAR, OR FLUORESCENT TONER PRINTER

(71) Applicant: UI Technologies, Inc., Las Vegas, NV (US)

(72) Inventors: Michael Raymond Josiah, North Patchogue, NY (US); Joseph Dovi, Lake Grove, NY (US)

(73) Assignee: UI Technologies, Inc., Las Vegas, NV (US)

( * ) Notice: Subject to any disclaimer, the term of this patent is extended or adjusted under 35 U.S.C. 154(b) by 0 days.

(21) Appl. No.: 14/879,548

(22) Filed: Oct. 9, 2015

Related U.S. Application Data

(63) Continuation-in-part of application No. 14/731,785, filed on Jun. 5, 2015.

(51) Int. Cl.
*G03G 15/00* (2006.01)
*G03G 15/08* (2006.01)

(52) U.S. Cl.
CPC ..... *G03G 15/0894* (2013.01); *G03G 15/0863* (2013.01); *G03G 15/0867* (2013.01)

(58) Field of Classification Search
CPC ..... G03G 15/0894; G03G 15/0872; G03G 15/553; G03G 15/0121; G03G 5/0696; G03G 21/1676; G03G 21/18
USPC ..... 399/27; 400/76
See application file for complete search history.

(56) References Cited

U.S. PATENT DOCUMENTS

| | | | |
|---|---|---|---|
| 4,630,076 | A | 12/1986 | Yoshimura |
| 4,943,506 | A | 7/1990 | Demizu et al. |
| 5,223,906 | A | 6/1993 | Harris |
| 5,367,327 | A | 11/1994 | Harris |
| 6,114,077 | A | 9/2000 | Voets et al. |
| 6,203,953 | B1 | 3/2001 | Dalal |
| 6,535,712 | B2 | 3/2003 | Richards |
| 6,640,843 | B2 | 11/2003 | Lee |

(Continued)

FOREIGN PATENT DOCUMENTS

| | | |
|---|---|---|
| EP | 0280378 | 3/1995 |
| WO | 2014206673 | 12/2014 |

OTHER PUBLICATIONS

Robert-Bosch; Digital Transfer Media for Printers with White Toner; website; 8 pages; Heddesheim, Germany; http://www.seri-deco.fi/files/FOREVER%20No-Cut_white%20toner%20flyer.pdf.

(Continued)

*Primary Examiner* — Walter L Lindsay, Jr.
*Assistant Examiner* — Jessica L Eley
(74) *Attorney, Agent, or Firm* — Hankin Patent Law APC; Kevin Schraven; Jimmy Sauz

(57) ABSTRACT

A method and system for converting a toner cartridge printer to a white, clear or fluorescent toner printer. The method may comprise the steps of: providing a printer having one or more toner printing cartridges; removing at least one of the one or more toner printing cartridges; providing one or more white, clear, or fluorescent toner printing cartridges; installing one or more white, clear, or fluorescent toner printing cartridges into the printer; using raster image processor software for printing cartridge remapping; and printing one or more toner print layers using the installed white, clear, or florescent toner printing cartridges in one pass.

19 Claims, 4 Drawing Sheets

(56) References Cited

U.S. PATENT DOCUMENTS

| | | | | |
|---|---|---|---|---|
| 6,769,766 | B2 | 8/2004 | Suzuki et al. | |
| 6,975,428 | B1 | 12/2005 | Ernst | |
| 7,061,503 | B2 | 6/2006 | Newman | |
| 7,134,749 | B2 | 11/2006 | Ben-Zur et al. | |
| 7,261,390 | B2 | 8/2007 | Nishino | |
| 7,717,532 | B2 | 5/2010 | Kroon et al. | |
| 8,205,981 | B1 | 6/2012 | Marino et al. | |
| 8,298,737 | B2 | 10/2012 | Kadokura | |
| 8,348,399 | B2 | 1/2013 | Gengrinovich | |
| 8,351,100 | B2 | 1/2013 | Mestha et al. | |
| 8,599,436 | B2 | 12/2013 | Sano et al. | |
| 8,728,696 | B2 | 5/2014 | Yamada | |
| 8,735,320 | B2 | 5/2014 | La Costa | |
| 8,784,508 | B2 | 7/2014 | Ellis | |
| 8,851,641 | B2 | 10/2014 | Kamiyama | |
| 2004/0037573 | A1* | 2/2004 | Hirota | G03G 15/0121 399/12 |
| 2004/0252173 | A1 | 12/2004 | Ben-Zur et al. | |
| 2005/0264632 | A1 | 12/2005 | Glass et al. | |
| 2006/0034509 | A1 | 2/2006 | Lu et al. | |
| 2006/0162586 | A1 | 7/2006 | Fresener et al. | |
| 2008/0218539 | A1 | 9/2008 | Hill et al. | |
| 2009/0040249 | A1 | 2/2009 | Wouters | |
| 2013/0108345 | A1* | 5/2013 | Yamamoto | G03G 15/5087 400/76 |
| 2013/0113854 | A1 | 5/2013 | Iwata | |
| 2013/0235398 | A1 | 9/2013 | Bhatti et al. | |
| 2013/0251411 | A1* | 9/2013 | Miura | G03G 15/6585 399/223 |
| 2013/0308985 | A1 | 11/2013 | Kim | |
| 2013/0330522 | A1 | 12/2013 | Suzuki et al. | |
| 2014/0056617 | A1* | 2/2014 | Rimai | G03G 15/224 399/130 |
| 2014/0292855 | A1 | 10/2014 | Chang | |

OTHER PUBLICATIONS

Anthony Dinezza; Can a Printer Print White Color; website forum; Apr. 15, 2014; 3 pages; http://superuser.com/questions/663316/can-a-printer-print-white-color.

T-Shirt Forums; Okidata Laser with White Toner; website forum; Jan. 4, 2013; 7 pages; http://www.t-shirtforums.com/laser-heat-transfer-paper/t209046.html.

Top Useful Solutions; DIY White Toner Laser Printer; website forum; Mar. 20, 2015; 4 pages; http://topusefulsolutions.com/10813/diy-white-toner-laser-printer.

Heat Press Nation; White Toner; website; 5 pages; Brea, California; http://www.heatpressnation.com/catalogsearch/result/?q=white+toner&x=0&y=0.

Inkfilling; White Toner; website forum; 2 pages; Irwindale, California; https://www.inkfilling.com/inquiries/thread_1933.html.

Alibaba; White Toner; website; 2 pages; China; http://sourcing.alibaba.com/rfq_search_list.htm?fsb=y&IndexArea=rfq_en&CatId=&SearchText=white+toner.

Superuser; What will happen if i put colored toner in Black white laser printer cartridge; website forum; Jan. 20, 2010; 2 pages; http://superuser.com/questions/98147/what-will-happen-if-i-putcolored-toner-in-black-white-laser-printer-cartridge.

Superuser; Can I refill monochrome laser printer cartridge with color powder; website forum; Jan. 3, 2015; 2 pages; http://superuser.com/questions/860019/can-i-refill-monochrome-laserprinter-cartridge-with-color-powder.

Denis Cormier, et al.; Experiments in Layered Electro-Photographic Printing; manuscript; 7 pages; North Carolina State University; Raleigh, North Carolina; http://sffsymposium.engr.utexas.edu/Manuscripts/2000/2000-33-Cormier.pdf.

Graphics One; OKI pro920WT White Toner Solution; catalog; 2 pages; http://www.graphicsone.com/stage/media/catalog/product/PDFs/920%20WT%20Quick%20FAQs.pdf.

Wikipedia; Toner refill; website; Apr. 29, 2015; 3 pages; http://en.wikipedia.org/wiki/Toner_refill.

Uni-Kit; Toner Refill Instructions; manual; 142 pages; http://www.refillinstructions.com/tonerrefillinstructions.pdf.

Amazon; 4 pack toner refill kit; website; 6 pages; http://www.amazon.com/Refill-LaserJet-2605DTN-Cartridges-INCLUDES/dp/B001L1A1DS.

Florent Pellegrin; Refilling method for ink jet cartridges; manual; 2007; 252 pages; Thailand; http://www.refillinstructions.com/GeneralRefill.pdf.

Walmart; Ink Refill Kit; website; 4 pages; http://www.walmart.com/c/ep/ink-refill-kit.

Alibaba; White Ink Refill; website; 8 pages; China; http://www.alibaba.com/showroom/white-ink-refill.html.

Print Country; Printer Ink Cartridges Refill Kit Troubleshooting; website; Lihua, Hawaii; 6 pages; http://www.printcountry.com/faq-troubleshooting-refill-kits.asp.

Coldesi Colman; Viper DTG Printer Training Videos—Filling Machine With Ink; video; Mar. 7, 2013; https://www.youtube.com/watch?v=sLyN8fCoy9Q.

Pantograms; Make More Money with our Stitch-n-Print Solutions Combining Embroidery With White Toner Laser Printers; website article; Tampa, Florida; 5 pages; http://www.pantograms.com/stitchnprintembroideryandheattransfers.asp.

Automatic Transfer, Inc.; White Sublimation Laser Toner; website; Alpha, New Jersey; 3 pages; http://www.atttransfer.com/whitetoner.html.

The Recycler; OKI's white toner technology wins awards; website article; Mar. 22, 2013; 2 pages; http://www.therecycler.com/posts/okis-white-toner-technology-winsawards/.

Print Planet; The 5th Toner; website forum; Apr. 6, 2012; 2 pages; http://printplanet.com/forums/digital-printing-discussion/28580-5thtoner.

Durst Tau 150 8C; High Speed Digital UV Inkject Label Press; YouTube video; Dec. 21, 2011; https://www.youtube.com/watch?v=va8KwofWDus.

Epson; WT7900 White Based Printing Technology; website; https://www.epson.com/cgibin/Store/jsp/Pro/SeriesStylusProWT7900/Overview.do?UseCookie=yes.

Oce; Oce White Ink Technology; website; http://global.oce.com/technologies/white-ink-technology.aspx.

Smartpress; White Ink Printing; website; http://smartpress.com/pages/white-ink-printing.

Xaar; UV White Inkjet Inks for Single-Pass Label Applications; brochure; Jan. 4, 2015; http://www.xaar.com/en/MediaDocuments/UV-inks-white-paper.pdf.

Tshirt Forum; OKI Tabloid Printer with White Toner; website forum; May 18, 2013; http://www.t-shirtforums.com/printers-inks-inkjet-laser-transfers/t151402-12.html.

* cited by examiner

METHOD AND SYSTEM FOR CONVERTING A TONER CARTRIDGE PRINTER TO A WHITE, CLEAR, OR FLUORESCENT TONER PRINTER

CROSS-REFERENCE TO RELATED APPLICATIONS

This Patent Application is a Continuation-in-Part of U.S. Non-Provisional patent application Ser. No. 14/731,785, filed on Jun. 5, 2015, titled "Method and System for Converting a Toner Cartridge Printer to a White Toner Printer," by co-inventors Michael Raymond Josiah and Joseph Dovi, the contents of which are expressly incorporated herein by this reference as though set forth in their entirety and to which priority is claimed.

FIELD OF USE

The present disclosure relates generally to printing cartridge replacements, and more specifically, to methods and systems for converting a standard toner cartridge printer to a printer that prints with white, fluorescent white, clear, or fluorescent toner.

BACKGROUND

Traditional Cyan (C), Magenta (M), Yellow (Y), and Black (K) (or CMYK) laser or Light Emitting Diode (LED) type printers come standard with Cyan, Magenta, Yellow and Black toner and/or drum cartridges. However, traditional black toner printers and CMYK toner printers are generally unable to print in white as the foreground or as the background because these printers lack white toner and/or drum cartridges and the appropriate raster image processor (RIP) software for printing cartridge re-mapping. Printing in white toner is feasible through the use of white toner printers and would generally allow a user to print on dark or clear media, but white media printers are dedicated to CMYW only where white is always a top color. This system does not allow printing on clear or dark media and may require the user to buy an entirely new printer.

Printers that print both in white and color are CMYKW printers with a minimum of five toner printing cartridges and white is always the last cartridge which does not allow a layer of white to be put down first as a background color.

An LED printer is a type of toner printer similar to a laser toner printer. LED technology uses a light-emitting diode array as a light source instead of a laser.

Typical CMYK printers use all four colors but assume that the media used is white. Thus, any blank or empty area in an image is assumed to be white by the printer. This is usually appropriate for light or white media, but typically causes problems when darker media is used. For example, a picture of a person wearing a white shirt on white paper will appear white, but will be the color of the media when colored media is used.

Thus, there is a need for a system and method for converting or retrofitting a standard CMYK (four cartridge) toner printer to print using white toner and wherein the layer of white toner may be a background or foreground color.

SUMMARY OF THE EMBODIMENTS

To minimize the limitations in the cited references, and to minimize other limitations that will become apparent upon reading and understanding the present specification, the toner printer converting systems and methods disclosed herein preferably allow a user to convert a standard printer into one that prints using white, clear, or fluorescent toner.

In various embodiments, the methods and systems may be used to convert a traditional toner printing cartridge(s) and/or drum(s) printing machine to a printing machine that prints white, clear, or fluorescent from one or more of the toner printing cartridge(s).

In a preferred embodiment, a standard toner cartridge printer is converted by replacing the color or black toner printing cartridge in the first toner printing cartridge position, which allows the printer to print white as a background color prior to printing the other colors.

In another embodiment, a standard toner cartridge printer is converted by replacing the color or black toner printing cartridge in the last toner printing cartridge position, which allows the printer to print white as a foreground color.

In both embodiments immediately above, the addition of the white toner may be accompanied by cartridge re-mapping using RIP software. The RIP software allows a user to set how much white toner to be added to maximize the look of the finished print job.

In one embodiment, the cartridge re-mapping is used to allow a white toner printing cartridge to be put in the "K" (black) slot (which may be the first slot in the printer) of a CYMK printer and the CYM cartridges are all in their original slots. In this manner, a layer of white may be put down, on top of which a full color layer may be printed, and may be used on clear and dark media.

In another embodiment, the cyan cartridge is replaced by a white toner printing cartridge and the black cartridge is replaced with a cyan cartridge. In this manner, white may be a foreground layer or be printed concurrently with the other colors. The RIP software allows the printer to print the color, black, and white in a layered or pass format.

In one embodiment the printing cartridge integrated circuits (chips) may be swapped along with the toner printing cartridges, but the RIP software is configured to ensure that the correct colors print regardless of which slot the colors are placed.

The RIP software may allow or feature color rasterization, which enables the printer to use less toner by selectively removing pixels to use less toner. This feature gives a nicer feel and adds more durability to the finished product.

In one embodiment of the conversion method, a CMYK toner printer may be converted to CMYW or FL CMYW, wherein the FL stands for Florescent, and wherein the printing cartridges may be placed in any order within the printer. The RIP software may be used to map the final placement of each toner color in the CMYW or FL CMYW, wherein W may be white, florescent white, clear, or a florescent color.

In one embodiment, a CMYW printer may be converted to any combination of fluorescent or standard colors.

One embodiment may be a method of converting a printer to print with white toner, comprising the steps of providing a toner printer. The toner printer may have four printing cartridges and may comprise a black toner printing cartridge, a cyan toner printing cartridge, a magenta toner printing cartridge, and a yellow toner printing cartridge. The black toner printing cartridge may be in a first position of the toner printer. The black toner may be removed from the printing cartridge from the toner printer. A white toner printing cartridge may be provided. The white toner printing cartridge may be installed into the first position of the toner printer. A raster image processor (RIP) software may be provided for printing cartridge remapping such that a first layer using only the white toner printing cartridge may be printed, and then a second layer may be printed over the white layer in one pass. The second layer may be non-white. The printer may be a laser toner printer. The printer may be an LED toner printer. The four toner printing cartridges of the printer may comprise four separate drums and four separate toner printing cartridges. The four toner printing cartridges of the printer may comprise four separate toner printing cartridges and one single drum cartridge. The four toner printing cartridges of the printer may comprise four combined toner and drum printing cartridges. The installing of the white toner printing cartridge in the first position may allow the printer to print the first layer using only the white toner printing cartridge. Additionally, the provided white toner printing cartridge may comprise: disassembling the removed black toner printing cartridge, which may be new or used; emptying and cleaning the removed black toner printing cartridge, such that an empty printing cartridge may be created; and filling the empty printing cartridge with a white toner.

Another embodiment may be a method of converting a printer to print with white toner, comprising the steps of providing a toner printer. The toner printer may have four printing cartridges. The four printing cartridges may comprise a black toner printing cartridge, a cyan toner printing cartridge, a magenta toner printing cartridge, and a yellow toner printing cartridge. The black toner printing cartridge may be in a first position of the toner printer. The black toner printing cartridge may be removed from the toner printer. A cyan toner printing cartridge may be in a fourth position of the toner printer. The cyan toner printing cartridge may be removed from the toner printer. A white toner printing cartridge may be provided. A cyan toner printing cartridge may be installed into the first position of the toner printer. The white toner printing cartridge may be installed into the fourth position of the toner printer. Raster image processor (RIP) software may provide for printing cartridge remapping. A first layer not using the white toner printing cartridge may be printed, and then a second layer may be printed over the first layer. The second layer may print only using the white toner printing cartridge. A layer using all four of the four toner printing cartridges may be printed. The printer may be a LED toner printer. The four toner printing cartridges of the printer may comprise four separate drums and four separate toner printing cartridges. The four toner printing cartridges of the printer may comprise four separate toner printing cartridges and one single drum cartridge. The four toner printing cartridges of the printer may comprise four combined toner and drum printing cartridges. Additionally, the provided white toner printing cartridge may comprises: disassembling the removed black toner printing cartridge, which may be new or used; emptying and cleaning the removed black toner printing cartridge, such that an empty printing cartridge may be created; and filling the empty printing cartridge with a white toner.

Another embodiment may be a method of converting a printer to print with clear toner, comprising the steps of providing a toner printer. The toner printer may have four printing cartridges. The four printing cartridges may comprise a black toner printing cartridge, a cyan toner printing cartridge, a magenta toner printing cartridge, and a yellow toner printing cartridge. The black toner printing cartridge may be in a first position of the toner printer. The black toner printing cartridge may be removed from the toner printer. The cyan toner printing cartridge may be in a fourth position of the toner printer. The cyan toner printing cartridge may be removed from the toner printer. A clear toner printing cartridge may be provided. A cyan toner printing cartridge may be installed into the first position of the toner printer. The clear toner printing cartridge may be installed into the fourth position of the toner printer. A raster image processor (RIP) software may be provided for printing cartridge remapping. A first layer not using the clear toner printing cartridge may be printed and then a second layer may be printed over the first layer. The second layer may print only using the clear toner printing cartridge. The printer may be a LED toner printer. The four toner printing cartridges of the printer may comprise four separate drums and four separate toner printing cartridges. The four toner printing cartridges of the printer may comprise four separate toner printing cartridges and one single drum cartridge. The four toner printing cartridges of the printer may comprise four combined toner and drum printing cartridges. The provided clear toner printing cartridge may comprise: disassembling the removed black toner printing cartridge, which may be new or used; emptying and cleaning the removed black toner printing cartridge, such that an empty printing cartridge may be created; and filling the empty printing cartridge with a clear toner.

Another embodiment may be a method of converting a printer to print with florescent toner, comprising the steps: providing a toner printer. The toner printer may have four printing cartridges. One or more of the four toner printing cartridges may be removed from the toner printer, such that there may be empty toner printing cartridge position(s). Florescent toner printing cartridge(s) may be provided. Fluorescent toner printing cartridge(s) may be installed into empty toner printing cartridge(s). Raster image processor (RIP) software may provide for printing cartridge remapping. The CMYK printer may be a CMYW printer. All four of the four toner printing cartridges may be removed and replaced with four florescent toner printing cartridges. The four toner printing cartridges of the printer may comprise four separate drums and four separate toner printing cartridges. The four toner printing cartridges of the printer may comprise four separate toner printing cartridges and one single drum cartridge. The four toner printing cartridges of printer may comprise four combined toner and drum printing cartridges.

It is an object of the present system and method to convert a standard toner cartridge printer into white, clear, or fluorescent toner printer.

It is an object of the present system to overcome the limitations of the prior art.

It is an object of the present system and method to convert a standard toner cartridge printer into white toner printer in order to print white toner as the foreground.

It is an object of the present system and method to convert a standard toner cartridge printer into white toner printer in order to print white toner as the background.

It is an object of the present system and method to convert a standard toner cartridge printer into white toner printer in order to print in layers of colored and/or white toner.

It is an object of the present system and method for raster image processor software to provide cartridge remapping, which allows the system to print using white toner from different cartridge positions.

It is an object of the present system and method for raster image processor software to assist in printing white toner as the foreground and/or background and/or in layers with colored toner.

Other features and advantages inherent in the system and method for converting a standard toner cartridge printer into white or fluorescent toner printer claimed and disclosed will become apparent to those skilled in the art from the following detailed description and its accompanying drawings.

BRIEF DESCRIPTION OF THE DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps which are illustrated. When the same numeral appears in different drawings, it refers to the same or like components or steps.

DETAILED DESCRIPTION OF THE ILLUSTRATIVE EMBODIMENTS

Figure 1:
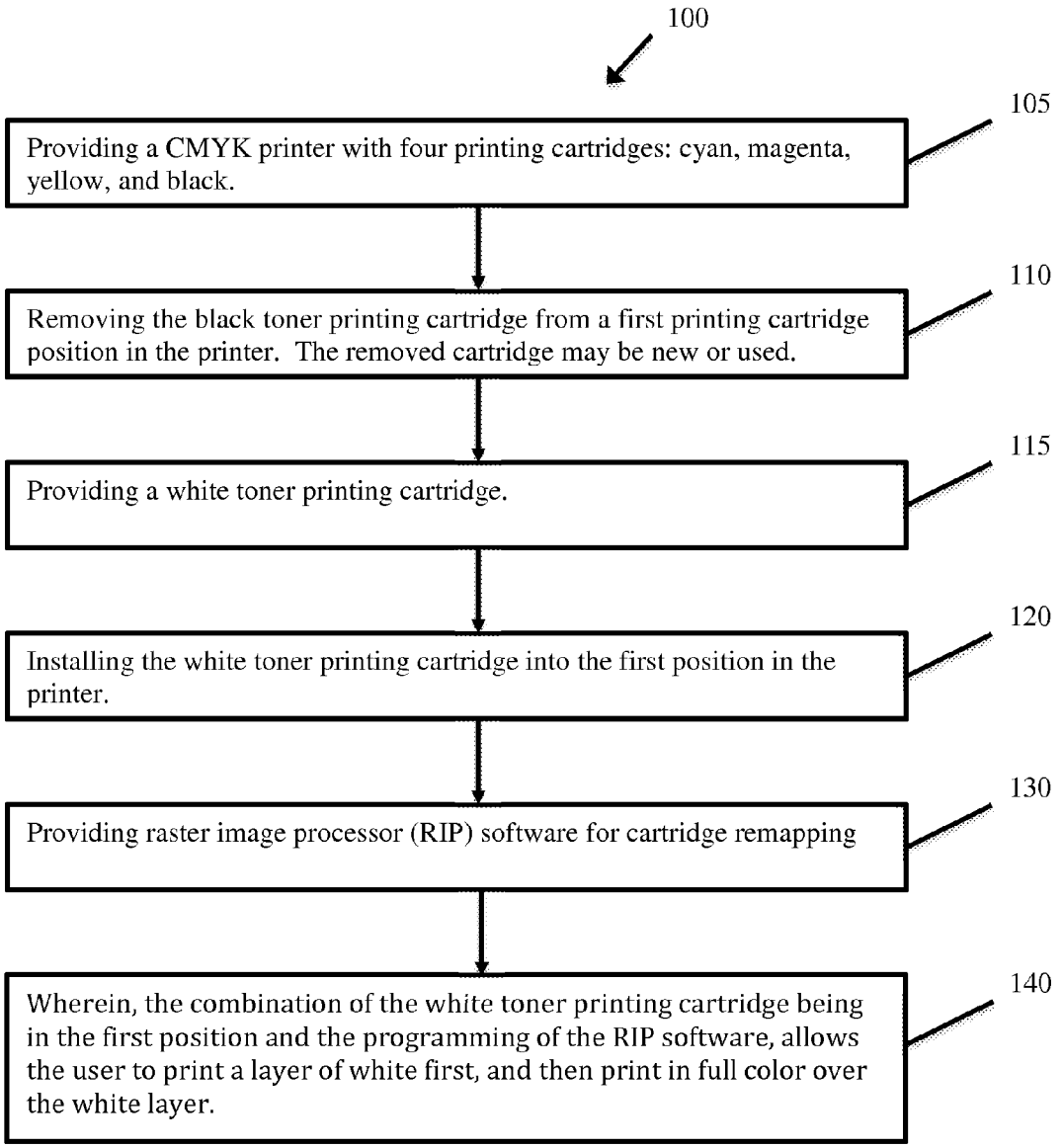
FIG. 1 is a flow block diagram of one embodiment of the method of converting a CMYK printer to print white in the background.

In the following detailed description, numerous specific details are set forth in order to provide a thorough understanding of various aspects of one or more embodiments. However, the one or more embodiments may be practiced without some or all of these specific details. In other instances, well-known methods, procedures, and/or components have not been described in detail so as not to unnecessarily obscure aspects of embodiments.

While multiple embodiments are disclosed, still other embodiments will become apparent to those skilled in the art from the following detailed description. As will be realized, these embodiments are capable of modifications in various obvious aspects, all without departing from the spirit and scope of protection. Accordingly, the screen shots, figures, and the detailed descriptions thereof, are to be regarded as illustrative in nature and not restrictive. Also, the reference or non-reference to a particular embodiment of the invention shall not be interpreted to limit the scope of protection.

The present specification discloses a system and method for converting a toner cartridge printer to a white, color, or fluorescent toner printer. The method and system for converting a toner cartridge printer to a white or fluorescent toner preferably requires no special or dedicated printer drivers.

In the following description, certain terminology is used to describe certain features of one or more embodiments. For purposes of the specification, unless otherwise specified, the term "printing cartridge(s)" generally refers to a toner cartridge, a laser toner cartridge, a LED toner cartridge, a drum cartridge, and/or a combined toner and drum cartridge.

As used herein, the term "toner" generally refers to a powder, particulate, or dry ink that is used in laser printers, printers, and printing machines to form the printed text and images on the medium being printed. Generally, toner particles are melted by the heat of a fuser, and bound to the media.

Regarding a CMYW printer, the W preferably stands for white, but the W in some embodiments may also stand for florescent white, clear, or a florescent color.

Regarding a FL CMYW printer, the FL stands for florescent, wherein the cyan, magenta, yellow, and/or white toner printing cartridges may be florescent. Before the present printer conversion method, florescent toner printing cartridges had never been substituted into a CMYK or CMYW printer.

The present method and system for converting a toner cartridge printer to a white, clear, or fluorescent toner printer may allow the conversion of: (1) a conversion of a CMYK machine that has separate toner and drum cartridges; (2) a conversion of a CMYK machine that has separate toner and drum cartridges; and (3) a conversion of a CMYK machine with a single drum and separate toner printing cartridges.

Regarding the conversion of a CMYK machine to include a clear toner printing cartridge, the below discussion of white toner printing cartridge conversion is essentially identical, with the exception that a clear toner printing cartridge is substituted for a white toner printing cartridge.

Regarding the conversion of a CMYK machine to include a florescent white toner printing cartridge, the below discussion of white toner printing cartridge conversion is essentially identical, with the exception that a florescent white toner printing cartridge is substituted for a white toner printing cartridge.

Regarding the conversion of a CMYK machine to a florescent toner printer, one or more of the original toner printing cartridges may be replaced with one or more florescent toner printing cartridges and the RIP software is utilized to map the toner printing cartridge positions to reflect the new florescent toner colors. In one embodiment the below discussion of white toner printing cartridge conversion is essentially identical, with the exception that a florescent toner printing cartridge is substituted for a white toner printing cartridge.

Regarding the conversion of a CMYK machine that has separate toner and drum cartridges, the conversion may comprise a replacing one of the color cartridges with a white toner printing cartridge and replacing the accompanying color drum with a white drum.

Regarding the conversion of a CMYK machine that has separate toner printing cartridges, but a single drum cartridge, the conversion may comprise replacing one of the color cartridges with a white toner printing cartridge and cleaning the accompanying drum portion of color toner and priming it with white toner.

Regarding the conversion of a CMYK machine that has combined toner and drum cartridges, the conversion may comprise a replacing one of the combined color cartridges with a combined white toner printing cartridge.

FIG. 1 is a flow block diagram of one embodiment of the method of converting a CMYK printer to print with white toner in the background. As shown in FIG. 1, one embodiment of the conversion method 100 may comprise providing a CMYK printer with four printing cartridges: cyan, magenta, yellow, and black 105. Preferably, the CMYK printer is a LED printer. In one embodiment the black toner printing cartridge may be in the first printing cartridge position. The method 100 may further comprise removing the black printing cartridge and/or drum cartridge from the printer 110. If there is only one drum cartridge that services all of the printing cartridges, the drum must be cleaned and primed with the clear or white toner. The method 100 may further comprise: providing a white toner printing cartridge and/or drum cartridge 115; installing the white toner and/or drum cartridge into the first slot or position in the CMYK printer 120; and providing raster image processor (RIP) software for printing cartridge remapping 130. Wherein, the combination of the white toner printing cartridge being in the first position and the programming of the RIP software, allows the user to print a layer of white first, and then print in full color over the white layer 140. Preferably the white toner printing cartridge has the appropriate chip. The white toner printing cartridge may be provided by disassembling the removed printing cartridge, emptying and cleaning the removed printing cartridge to create an empty printing cartridge, and then filling the empty printing cartridge with a white toner. The cleaned printing cartridge may be a new or used printing cartridge. The installed printing cartridge may be a new or used printing cartridge.

Regarding the RIP software, the RIP software preferably utilizes printing cartridge mapping to enable the ability to move, change or swap printing cartridge locations in the printer. The RIP software may also add a customizable separate layer of white either on top or underneath the image depending on the cartridge configuration and printing needs. This fully customizable feature in the software (RIP) allows you to completely reconfigure the printer to get almost any desired effect. However, in a preferred embodiment the white toner background layer may be printed when the white toner is placed in the first printing cartridge position. Additionally, in a preferred embodiment the white toner foreground layer may be printed when the white toner is place in the last printing cartridge position. Regardless of the configuration, the white or clear layer is preferably done in a single pass.

The RIP software may also be configured to allow the user to print in full color, CMY black, and white, such that the white prints with the other colors at the same time in a single layer. Preferably, the single layer is put down in a single pass.

The modified printer may be converted back to a traditional CMYK printer by removing the white toner and/or drum cartridge from the first slot in the CMYK printer and re-installing the black toner printing cartridge and/or drum cartridge (if needed).

In an additional embodiment, the conversion method 100 may be a printing cartridge conversion utilizing a clear/transparent/translucent toner printing cartridge and/or drum cartridge in order to provide color intensity range.

In an additional embodiment, the conversion method 100 may be a printing cartridge conversion utilizing a florescent or florescent white toner printing cartridge and/or drum cartridge in order to provide color and intensity changes or a florescent or florescent white background layer.

Figure 2:
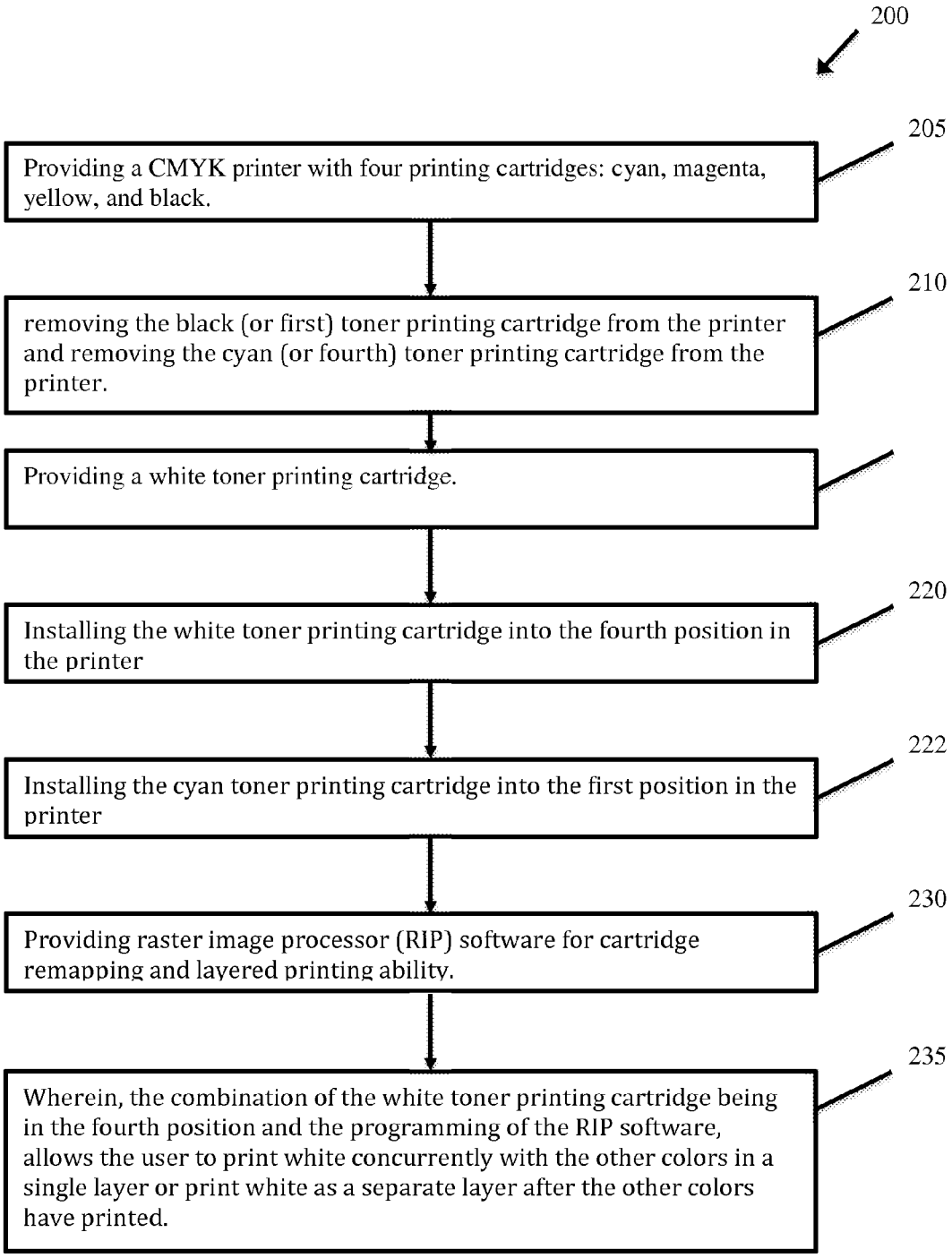
FIG. 2 is a flow block diagram of one embodiment of the method of converting a CMYK printer to print white in the foreground.

FIG. 2 is a flow block diagram of another embodiment of the method of converting a CMYK printer to print with white toner in the foreground. As shown in FIG. 2, one embodiment of the conversion method 200 may comprise providing a CMYK printer with four printing cartridges: cyan, magenta, yellow, and black 205. In one embodiment, the black toner printing cartridge may be in the first printing cartridge position. With the white in the first or last slot, the other color positions do not matter as long as they are mapped properly. For printing white in the foreground, the white toner printing cartridge is preferably in the fourth position. The method 200 may further comprise removing the black (or first) toner printing cartridge and/or drum cartridge from the printer and removing the cyan (or fourth) toner printing cartridge from the printer 210. If there is only one drum cartridge that services all of the printing cartridges, the drum must be cleaned and primed with the appropriate clear, white, or cyan toner at the appropriate location on the drum. The method 200 may further comprise: providing a white toner printing cartridge and/or drum cartridge 215; installing the white toner printing cartridge and/or drum cartridge into the fourth slot or position in the printer 220, which previously housed the cyan (or some other color) toner printing cartridge; installing the cyan toner printing cartridge and/or drum cartridge into the first slot or position in the printer 222, which previously housed the black (or some other color) printing cartridge; and providing raster image processor (RIP) software for printing cartridge remapping and layered printing ability 230. Wherein, the combination of the white toner printing cartridge being in the fourth position and the programming of the RIP software, allows the user to print white concurrently with the other colors in a single layer or print white as a separate layer after the other colors have printed 235. The white toner printing cartridge preferably has the appropriate chip. The white toner printing cartridge may be provided by disassembling the black removed printing cartridge, emptying and cleaning the black removed printing cartridge to create an empty printing cartridge, and then filling the empty printing cartridge with a white toner.

The modified printer may be converted back to a traditional CMYK printer by removing the white and cyan toner printing cartridges and/or drum cartridges from the fourth and first slots in the CMYK printer and re-installing the cyan and black toner printing cartridges and/or drum cartridge into their original positions.

In an additional embodiment, the conversion method 200 may be a printing cartridge conversion utilizing a clear/transparent/translucent toner printing cartridge and/or drum cartridge in order to provide an overlay of clear toner that seals in the color layer.

In an additional embodiment, the conversion method 200 may be a printing cartridge conversion utilizing a florescent or florescent white toner printing cartridge and/or drum cartridge in order to provide color and intensity changes or a florescent or florescent white foreground layer.

In one embodiment, a CMYK printer, such as a CMYW printer, may be altered to feature any combination of fluorescent or standard colors.

Figure 3:
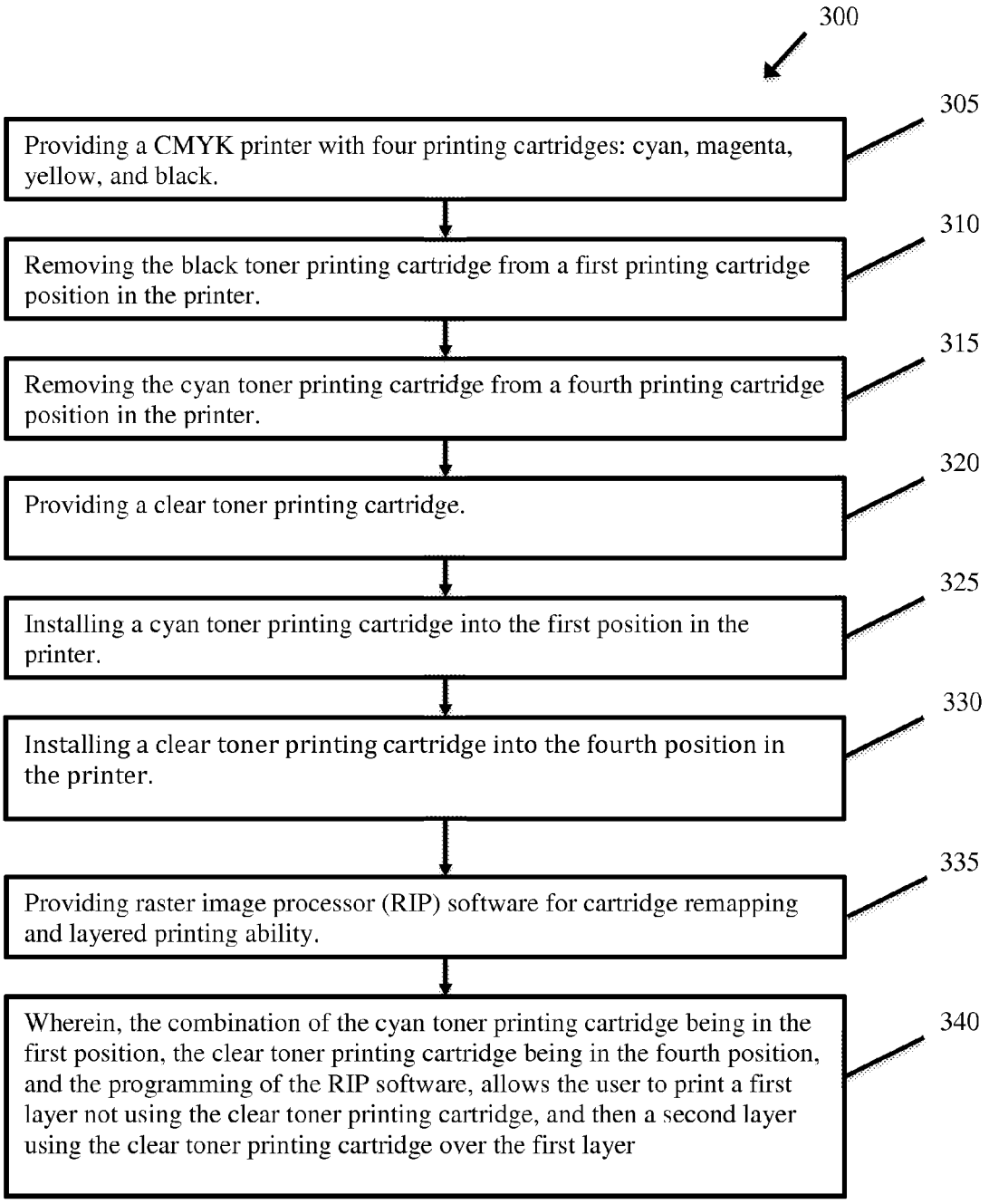
FIG. 3 is a flow block diagram of one embodiment of the method of converting a CMYK printer to print with clear toner.

FIG. 3 is a flow block diagram of another embodiment of the method of converting a CMYK printer to print with clear toner. As shown in FIG. 3, one embodiment of the conversion method 300 may comprise providing a CMYK printer with four printing cartridges: cyan, magenta, yellow, and black 305. In one embodiment, the black toner printing cartridge may be in the first printing cartridge position and the cyan toner printing cartridge may be in the fourth printing cartridge position. With a clear toner printing cartridge in the first or last slot, the other color positions do not matter as long as they are mapped properly. For printing clear as a second layer, the white toner printing cartridge is preferably in the fourth position. The method 300 may further comprise removing the black (or first) toner printing cartridge and/or drum cartridge from the printer and removing the cyan (or fourth) toner printing cartridge from the printer 310, 315. If there is only one drum cartridge that services all of the printing cartridges, the drum must be cleaned and primed with the appropriate clear or cyan toner at the appropriate location on the drum. The method 300 may further comprise: providing a clear toner printing cartridge and/or drum cartridge 320; installing the clear toner printing cartridge and/or drum cartridge into the fourth slot or position in the printer 330, which previously housed the cyan toner printing cartridge; installing the cyan toner printing cartridge and/or drum cartridge into the first slot or position in the printer 325, which previously housed the black printing cartridge; and providing raster image processor (RIP) software for printing cartridge remapping and layered printing ability 335. Wherein, the combination of the clear toner printing cartridge being in the fourth position and the programming of the RIP software, allows the user to print clear concurrently with the other colors in a single layer or print clear as a separate layer after the other colors have printed 340. The clear toner printing cartridge preferably has the appropriate chip. The clear toner printing cartridge may be provided by disassembling the black removed printing cartridge, emptying and cleaning the black removed printing cartridge to create an empty printing cartridge, and then filling the empty printing cartridge with a clear toner. Alternatively, the clear toner printing cartridge may be new and unused.

The modified printer may be converted back to a traditional CMYK printer by removing the clear and cyan toner printing cartridges and/or drum cartridges from the fourth and first slots in the CMYK printer and re-installing the cyan and black toner printing cartridges and/or drum cartridge into their original positions.

In an additional embodiment, the conversion method 300 may be a printing cartridge conversion utilizing a florescent or florescent white toner printing cartridge and/or drum cartridge in order to provide color and intensity changes or a florescent or florescent clear foreground layer.

In one embodiment, a CMYK printer, such as a CMYW printer, may be altered to feature any combination of fluorescent or standard colors.

Figure 4:
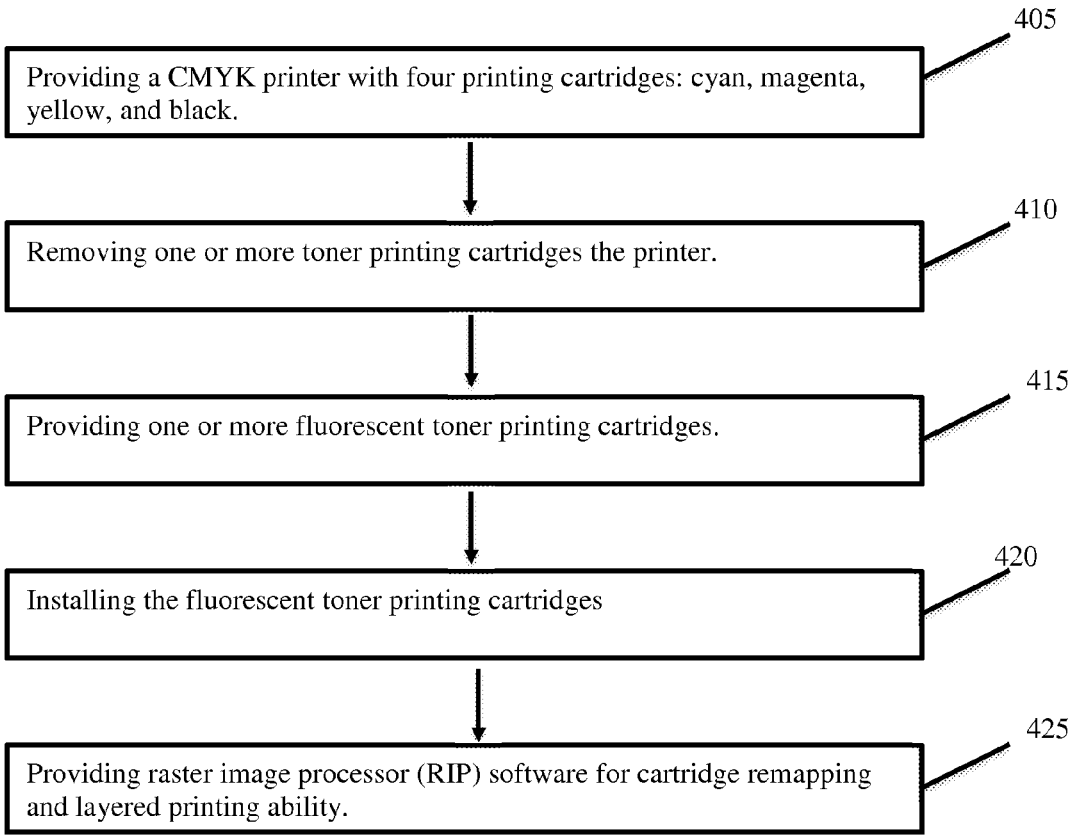
FIG. 4 is a flow block diagram of one embodiment of the method of converting a CMYK printer to print with florescent toner.

FIG. 4 is a flow block diagram of another embodiment of the method of converting a CMYK printer to print with fluorescent toner. As shown in FIG. 4, one embodiment of the conversion method 400 may comprise providing a CMYK printer with four printing cartridges: cyan, magenta, yellow, and black 405. In one embodiment, the method 400 may comprise removing one or more printing cartridges and/or drum cartridges from the printer 410. If there is only one drum cartridge that services all of the printing cartridges, the drum must be cleaned and primed with the appropriate fluorescent toner at the appropriate location on the drum. The method 400 may further comprise: providing one or more fluorescent toner printing cartridges and/or drum cartridges 415, which may have the appropriate chips; installing the fluorescent printing cartridge and/or drum cartridge 420; and providing raster image processor (RIP) software for printing cartridge remapping and layered printing ability 425. Wherein, the fluorescent toner printing cartridge(s) and the programming of the RIP software, allows the user to print fluorescent concurrently with the other colors in a single layer or print fluorescent as a separate layer. The fluorescent toner printing cartridge may be provided by disassembling one or more removed printing cartridges, emptying and cleaning the removed printing cartridge to create an empty printing cartridge, and then filling the empty printing cartridge with a fluorescent toner.

The modified printer may be converted back to a traditional CMYK printer by removing the fluorescent toner printing cartridge and/or drum cartridge in the CMYK printer and re-installing the color toner printing cartridge and/or drum cartridge into the original positions.

In one embodiment, a CMYK printer, such as a CMYW printer, may be altered to feature any combination of fluorescent or standard colors.

Unless otherwise stated, all measurements, values, ratings, positions, magnitudes, sizes, locations, and other specifications, which set forth in this specification, including in the claims that follow, are approximate, not exact. They are intended to have a reasonable range, which is consistent with the functions to which they relate and with what is customary in the art to which they pertain.

The foregoing description of the preferred embodiment has been presented for the purposes of illustration and description. While multiple embodiments are disclosed, still other embodiments will become apparent to those skilled in the art from the above detailed description, which shows and describes the illustrative embodiments. As will be realized, these embodiments are capable of modifications in various obvious aspects, all without departing from the spirit and scope of the present disclosure. Accordingly, the detailed description is to be regarded as illustrative in nature and not restrictive. Also, although not explicitly recited, one or more additional embodiments may be practiced in combination or conjunction with one another. Furthermore, the reference or non-reference to a particular embodiment shall not be interpreted to limit the scope of protection. It is intended that the scope of protection not be limited by this detailed description, but by the claims and the equivalents to the claims that are appended hereto.

Except as stated immediately above, nothing which has been stated or illustrated is intended or should be interpreted to cause a dedication of any component, step, feature, object, benefit, advantage, or equivalent to the public, regardless of whether it is or is not recited in the claims.

What is claimed is:

1. A method of converting a printer to print with white toner, comprising the steps:

providing a toner printer;

wherein said toner printer has four printing cartridges;

wherein said four printing cartridges comprise a black toner printing cartridge, a cyan toner printing cartridge, a magenta toner printing cartridge, and a yellow toner printing cartridge;

wherein said black toner printing cartridge is in a first position of said toner printer;

removing said black toner printing cartridge from said toner printer;

providing a white toner printing cartridge;

wherein said providing of said white toner printing cartridge comprises:

disassembling said removed black toner printing cartridge; emptying and cleaning said removed black toner printing cartridge, such that an empty printing cartridge is created; and filling said empty printing cartridge with a white toner;

installing said white toner printing cartridge into said first position of said toner printer;

providing raster image process (RIP) software for printing cartridge remapping; and printing a first layer using only said white toner printing cartridge, and then printing a second non-white layer over said white layer in one pass.

2. The method of converting a printer to print with white toner of claim 1, wherein said printer is a laser toner printer.

3. The method of converting a printer to print with white toner of claim 1, wherein said printer is a LED toner printer.

4. The method of converting a printer to print with white toner of claim 1, wherein said four toner printing cartridges of said printer comprise four separate drums and four separate toner printing cartridges.

5. The method of converting a printer to print with white toner of claim 1, wherein said four toner printing cartridges of said printer comprise four separate toner printing cartridges and one single drum cartridge.

6. The method of converting a printer to print with white toner of claim 1, wherein said four toner printing cartridges of said printer comprise four combined toner and drum printing cartridges.

7. The method of converting a printer to print with white toner of claim 1, wherein said installing of said white toner printing cartridge in said first position allows said printer to print said first layer using only said white toner printing cartridge.

8. A method of converting a printer to print with white toner, comprising the steps:

providing a toner printer;

wherein said toner printer has four printing cartridges;

wherein said four printing cartridges comprise a black toner printing cartridge, a cyan toner printing cartridge, a magenta toner printing cartridge, and a yellow toner printing cartridge;

wherein said black toner printing cartridge is in a first position of said toner printer;

removing said black toner printing cartridge from said toner printer;

wherein said cyan toner printing cartridge is in a fourth position of said toner printer;

removing said cyan toner printing cartridge from said toner printer;

providing a white toner printing cartridge;

wherein said providing of said white toner printing cartridge comprises:

disassembling said removed black toner printing cartridge; emptying and cleaning said removed black toner printing cartridge, such that an empty printing cartridge is created; and filling said empty printing cartridge with a white toner;

installing said cyan toner printing cartridge into said first position of said toner printer;

installing said white toner printing cartridge into said fourth position of said toner printer; and providing raster image processor (RIP) software for printing cartridge remapping.

9. The method of converting a printer to print with white toner of claim 8, further comprising the steps:

printing a first layer not using said white toner printing cartridge, and then printing a second layer over said first layer;

wherein said second layer prints only using said white toner printing cartridge.

10. The method of converting a printer to print with white toner of claim 8, further comprising the steps:

printing a layer using all four of said four toner printing cartridges.

11. The method of converting a printer to print with white toner of claim 8, wherein said printer is a LED toner printer.

12. The method of converting a printer to print with white toner of claim 8, wherein said four toner printing cartridges of said printer comprise four separate drums and four separate toner printing cartridges.

13. The method of converting a printer to print with white toner of claim 8, wherein said four toner printing cartridges of said printer comprise four separate toner printing cartridges and one single drum cartridge.

14. The method of converting a printer to print with white toner of claim 8, wherein said four toner printing cartridges of said printer comprise four combined toner and drum printing cartridges.

15. A method of converting a printer to print with clear toner, comprising the steps:

providing a toner printer;

wherein said toner printer has four printing cartridges;

wherein said four printing cartridges comprise a black toner printing cartridge, a cyan toner printing cartridge, a magenta toner printing cartridge, and a yellow toner printing cartridge;

wherein said black toner printing cartridge is in a first position of said toner printer;

removing said black toner printing cartridge from said toner printer;

wherein said cyan toner printing cartridge is in a fourth position of said toner printer;

removing said cyan toner printing cartridge from said toner printer;

providing a clear toner printing cartridge;

wherein said providing of said clear toner printing cartridge comprises:

disassembling said removed black toner printing cartridge; emptying and cleaning said removed black toner printing cartridge, such that an empty printing cartridge is created; and filling said empty printing cartridge with a clear toner;

installing said cyan toner printing cartridge into said first position of said toner printer;

installing said clear toner printing cartridge into said fourth position of said toner printer;

providing raster image processor (RIP) software for printing cartridge remapping; and printing a first layer not using said clear toner printing cartridge and then printing a second layer over said first layer;

wherein said second layer prints only using said clear toner printing cartridge.

16. The method of converting a printer to print with clear toner of claim 15, wherein said printer is a LED toner printer.

17. The method of converting a printer to print with clear toner of claim 15, wherein said four toner printing cartridges of said printer comprise four separate drums and four separate toner printing cartridges.

18. The method of converting a printer to print with clear toner of claim 15, wherein said four toner printing cartridges of said printer comprise four separate toner printing cartridges and one single drum cartridge.

19. The method of converting a printer to print with clear toner of claim 15, wherein said four toner printing cartridges of said printer comprise four combined toner and drum printing cartridges.

* * * * *